US005107986A

United States Patent [19]

Cooper

[11] Patent Number: 5,107,986

[45] Date of Patent: Apr. 28, 1992

[54] WRAP-AROUND CARRIER WITH ARTICLE RETAINER

[75] Inventor: Leonard M. Cooper, West Monroe, La.

[73] Assignee: Riverwood International Corporation, Denver, Colo.

[21] Appl. No.: 794,333

[22] Filed: Nov. 12, 1991

Related U.S. Application Data

[63] Continuation of Ser. No. 617,113, Nov. 21, 1990, abandoned.

[51] Int. Cl.[5] ..... B65D 75/00

[52] U.S. Cl. ..... 206/197; 206/140; 206/193; 206/434; 229/40

[58] Field of Search ..... 206/140, 147, 148, 149, 206/157, 175, 193, 197, 427, 434; 229/40

[56] References Cited

U.S. PATENT DOCUMENTS

| | | | |
|---|---|---|---|
| 2,975,891 | 3/1961 | Stone | 206/157 |
| 3,381,881 | 5/1968 | Ganz et al. | 206/149 |
| 3,432,029 | 3/1969 | Brown | 229/40 |
| 3,450,332 | 6/1969 | Padovano | 206/157 |
| 3,680,765 | 8/1972 | Harrelson | 206/197 |
| 3,747,835 | 7/1973 | Graser | 206/152 |
| 3,767,042 | 10/1973 | Ganz | 206/197 |
| 4,029,204 | 6/1977 | Mawizza | 206/140 |
| 4,034,852 | 7/1977 | Forrer | 206/193 |
| 4,324,328 | 4/1982 | Champlin | 206/193 |
| 4,526,316 | 7/1985 | Sutherland | 206/434 |
| 4,574,997 | 3/1986 | Ikeda | 229/40 |
| 4,611,754 | 9/1986 | Sutherland | 206/157 |
| 4,703,847 | 11/1987 | Oliff | 206/140 |
| 4,860,943 | 8/1989 | Cooper | 229/40 |
| 5,002,225 | 3/1991 | Bienaime | 206/140 |
| 5,031,770 | 7/1991 | Chaussadas | 229/40 |

*Primary Examiner*—David T. Fidei
*Attorney, Agent, or Firm*—Cornelius P. Quinn

[57] ABSTRACT

Integral retaining means in an open-ended wrap-around carrier for preventing the spaced bottom portions of articles such as tapered tubs from engaging each other and escaping the carrier through the open end. The bottom panel is comprised of inner and outer mechanically connected flaps. The outer bottom panel flap contains a retainer flap at each end connected along a fold line overlying the inner edge of an opening in the inner bottom panel flap. The retainer flaps extend up into the interior of the carrier through the openings in the inner bottom panel flap, and include spaced converging fold lines which create angled side walls for engaging the bottom portions of the articles.

12 Claims, 4 Drawing Sheets

FIG. 1
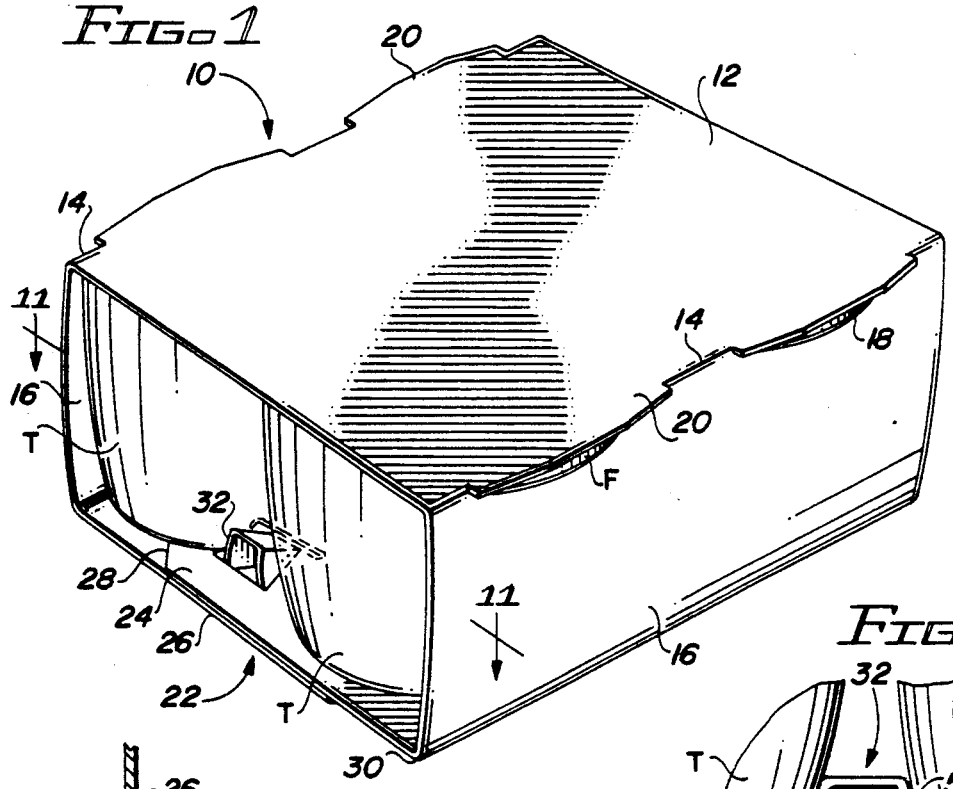
FIG. 2
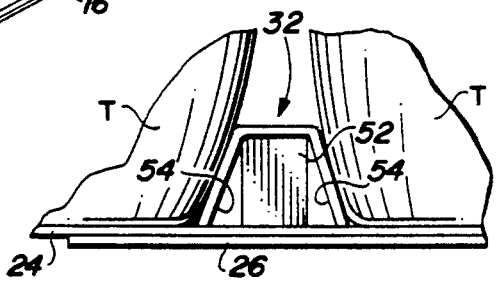
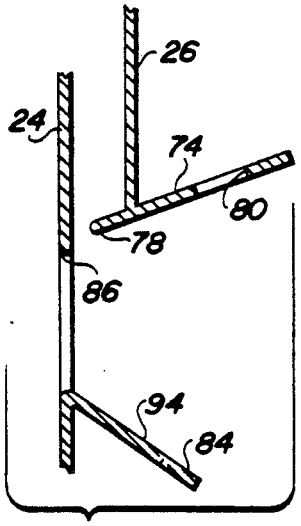
FIG. 6
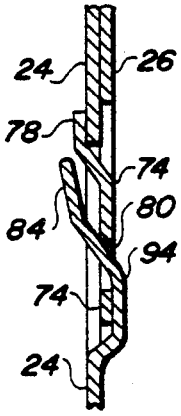
FIG. 8
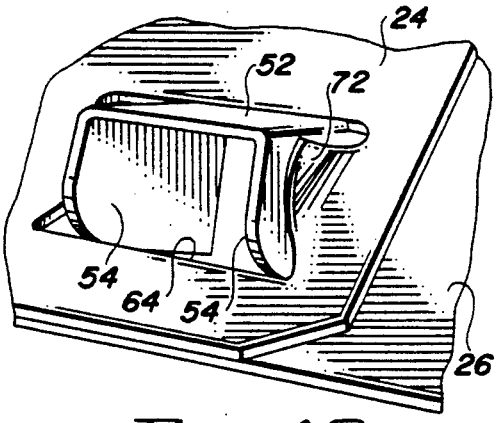
FIG. 10
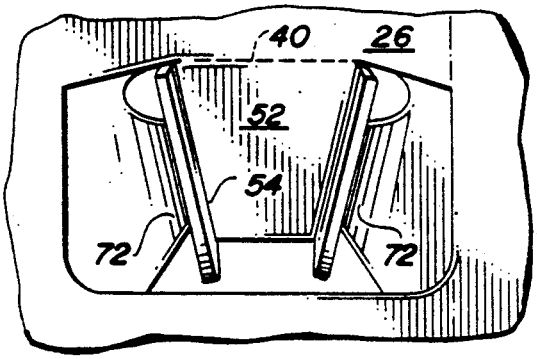
FIG. 9

WRAP-AROUND CARRIER WITH ARTICLE RETAINER

This is a continuation of application Ser. No. 07/617,113, filed Nov. 21, 1990, now abandoned.

FIELD OF THE INVENTION

This invention relates to article carriers and, more particularly, to article carriers having at least partially open ends.

BACKGROUND OF THE INVENTION

Wrap-around article carriers are commonly designed to have ends which are either partially or entirely open. In either case the carriers must be provided with means for preventing the articles from falling out the ends. Beverage cans, for example, are held in place partly by the tension applied by the carrier blank being wrapped very tightly about them and by the engagement of the top and bottom flanges of the cans with the edges of cutouts in the side panels of the carrier through which the flanges of the cans extend. This design is facilitated by the fact that cans have substantially flat tops and bottoms of the same diameter as the body of the can, which allows the carrier blank to be tightly wrapped around the cans.

Problems arise when the articles are not of uniform dimensions, and particularly when the articles are tapered at the bottom so as to cause the bottom portions of the articles to be spaced apart. Wrap-around carriers for use with tapered tubs of the type used as pudding or margarine containers are especially troublesome because of the difficulty in wrapping them tightly enough to prevent movement of the tubs when the package is lifted and carried. Movement of the containers is a problem even when the carrier includes side slots through which flanges on the tops of the tubs protrude, since such an arrangement does not hold the bottom portions of the tubs tightly in place.

Partial end panels extending up from the bottom panel could be provided to function as article retainers, as could corner end gusset panels or flaps. These measures would not be entirely satisfactory, however, because they require extra material to be used, making the carrier more costly to produce, and would not be able to prevent movement of the bottom portions of the container toward and away from each other. Moreover, the bottom of the carton is not stable under such conditions. What is needed is an article spacing or retention means which effectively prevents the spaced bottom portions of articles from moving with respect to each other, and also prevents the bottom portions of end articles in a carrier from moving toward the open end of the carrier.

BRIEF SUMMARY OF THE INVENTION

In accordance with the invention, a wrap-around carrier having a top panel and side panels is provided with a bottom panel comprised of overlapping inner and outer bottom panel flaps. The inner bottom panel flap contains an opening near an end of the carrier, and the outer bottom panel flap includes an integral article retaining flap which is hingedly connected to the outer bottom panel flap adjacent an inner edge portion of the opening. In forming the carrier, the retaining flap is pivoted up through the opening into the interior of the carrier, where it engages the bottom portions of adjacent end articles of adjacent rows of articles and prevents outward movement of the articles as well as relative movement of the articles toward and away from each other.

In a preferred form of the invention the retaining flap fold line is substantially parallel to the end of the carrier. In addition, the retaining flap includes spaced fold lines extending transversely of the retaining flap fold line. Preferably, the transverse fold lines converge toward each other, producing a tapered retaining flap capable of conforming to the sloped bottom portions of the articles.

The resulting retaining flap is three dimensional, having a central section directed toward the interior of the carrier and side faces or sections extending between adjacent end articles. Preferably, the opening through which the retainer flap extends is narrower than the normal distance between the side faces, thereby exerting a biasing force on the side faces to cause the flap to stand upright in the package. Because the retaining flap fits snugly between the spaced bottom portions of the end articles, the articles are held in place against outward movement.

In addition to the retaining flap holding the bottom portions of the end articles in place, it also functions to interconnect the inner and outer bottom panel flaps, thus providing reinforcement to any other locking means connecting the bottom panel flaps.

The above and other aspects of the invention, as well as other benefits, will readily be apparent from the more detailed description of the preferred embodiment which follows.

BRIEF DESCRIPTION OF THE DRAWINGS

FIG. 1 is a pictorial view of a wrap-around carrier incorporating the article retaining means of the present invention;

FIG. 2 is an enlarged partial end view of the carrier of FIG. 1, showing the article retaining means and its relationship to the adjacent end articles in more detail;

FIG. 6 is a transverse sectional view taken on line 6—6 of FIG. 5;

FIG. 8 is a transverse sectional view taken on line 8—8 of FIG. 7;

FIG. 9 is a partial plan view of the bottom panel of the carrier, showing the retaining flap in an intermediate position as it is being inserted into the associated opening in the inner bottom panel flap;

FIG. 10 is a partial pictorial view of the inner surface of the bottom panel of the carrier, showing the retaining flap in the intermediate position of FIG. 9, with the articles omitted for the sake of clarity.

DETAILED DESCRIPTION OF THE PREFERRED EMBODIMENT

Figure 11:
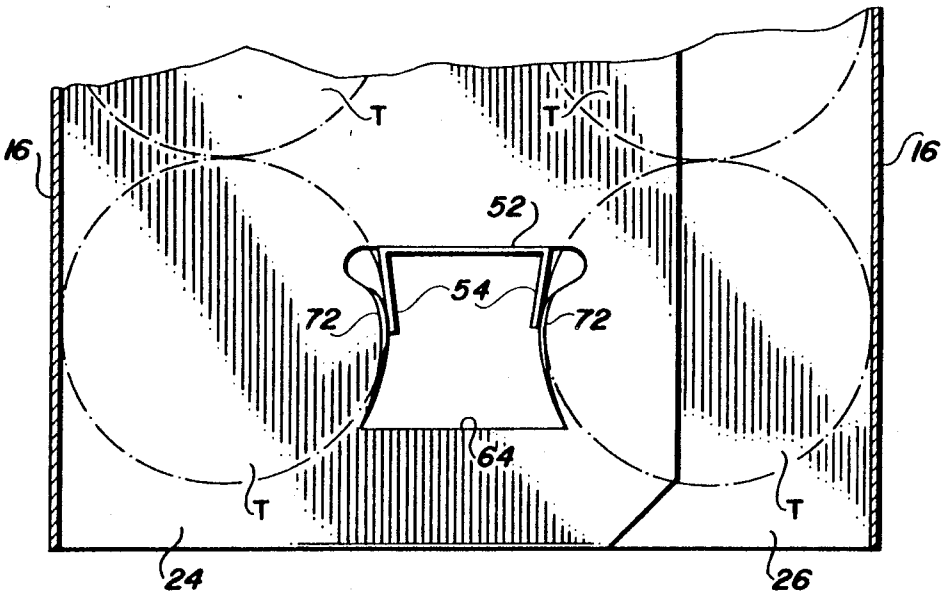
FIG. 11 is a sectional view of the carrier taken along line 11—11 of FIG. 1, showing the retainer flap in its fully open position, with the articles contained in the carrier shown in phantom.

Referring to FIG. 1, a wrap-around carrier 10 comprises a top panel 12 connected along fold lines 14 to side panels 16 which generally follow the contour of the articles T in the carrier. For purpose of illustrating the invention, the articles T are shown as comprising tubs of the type used to contain pudding or margarine or the like. It can be seen that the side panels are inwardly curved at the bottom portion of the carrier as a result of being tightly wrapped around the sloped side portions of the tubs. The side panels adjacent the top panel are provided with slots 18 through which the top flanges F of the tubs T extend. The top panel 12 is also provided with short extensions 20 which cover the flanges of the tubs.

A bottom panel 22 is formed by overlapped inner and outer bottom panel flaps 24 and 26. The inner bottom panel flap 24 is connected to one of the side panels 16 along fold line 28 while the outer bottom panel flap 26 is connected to the other side panel 16 along fold line 30. Extending up from the bottom panel 22 adjacent the end articles T in the adjacent rows of articles in the carrier is a retainer flap 32, which is shown in greater detail in FIG. 2. It can be seen that the retainer flap fits snugly between the angled bottom portions of the articles T, preventing the bottom portions from moving in a direction away from the side panels 16.

Figure 3:
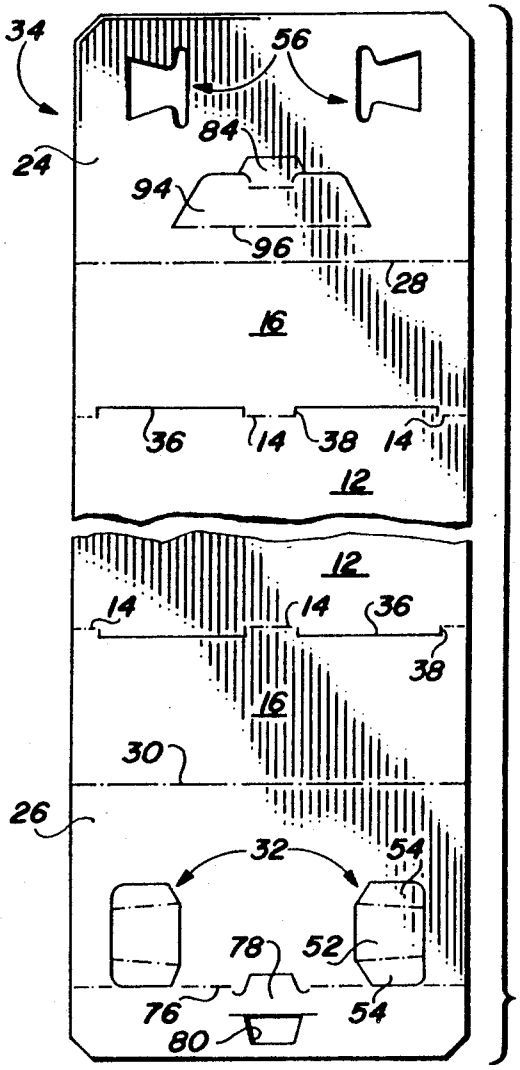
FIG. 3 is a plan view of a blank for forming the carrier of FIG. 1.

As shown in FIG. 3, wherein like reference numerals to those used in FIG. 1 denote like elements, a blank for forming the carrier 10 comprises a substantially rectangular sheet 34 of paperboard or other suitable material, with the top panel section 12 being in the center of the sheet and the other panel sections described above being successively connected along the fold lines referred to above. Thus the fold lines 14 connecting the top panel 12 to the side panels 16 are separated from each other by portions defined by the elongated slits 36 and the short connecting slits 38 which correspond to the extension of the top panel overlying the tub flanges in a carrier formed from the blank. The slots 18 of FIG. 1 through which the tub flanges protrude are formed when the side panels are folded down from the top panel, and the width of the slot corresponds to the length of the short slit 38.

Figure 4:
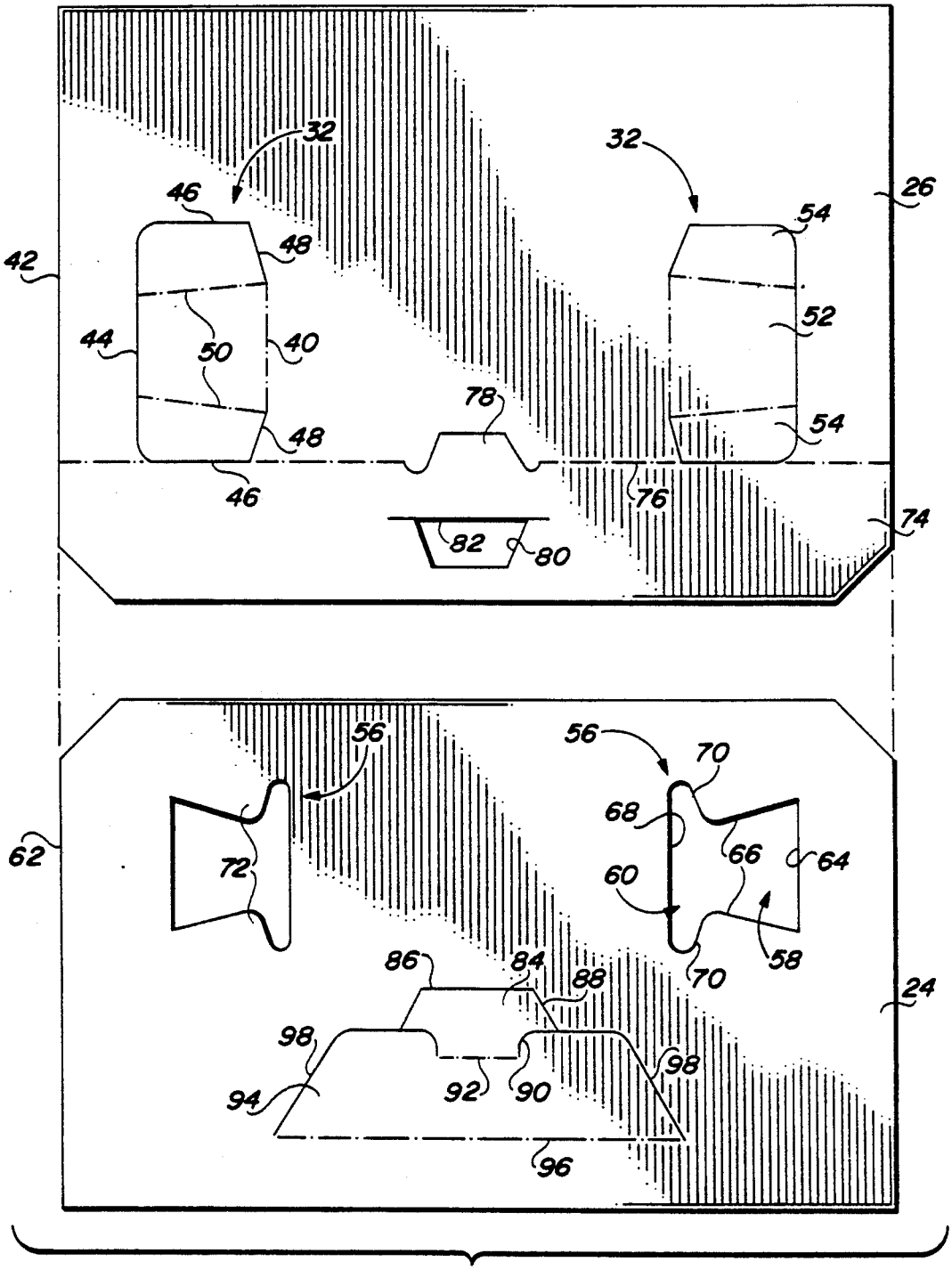
FIG. 4 is an enlarged plan view of the inner and outer bottom panel flaps just prior to being moved into overlapped condition.

In order to form a carrier from the blank 34, the blank is wrapped around the tubs or other articles to be packaged with the inner and outer bottom panel flaps 24 and 26 in overlapping relationship. The bottom panel flaps 24 and 26 are shown in FIG. 4 as they would appear after being folded in from side panels 16 about the fold lines 28 and 30 just prior to being moved into overlapping relationship. Referring to both FIGS. 3 and 4, the retaining flaps 32 are connected to the outer bottom panel flap 26 along fold lines 40 which are located between the end edges 42 of the flap 26 and the midpoint of the flap. The fold lines 40 are shown as being substantially straight and parallel to the end edges 42, although they may be slightly curved or angled as discussed in greater detail hereinafter. A slit 44 which is also substantially parallel to the end edges 42 of the outer bottom panel flap 26 and which is located between the fold lines 40 and the end edges 42, forms the opposite edge of the retainer flap 32. The sides of the retainer flap are defined by slits 46 which extend from the ends of slit 44 transversely of the end edges 42 toward the interior of the carrier, and by angled slits 48 connecting the slits 46 and the ends of the fold lines 40. The retainer flap 32 further includes two fold lines 50 which extend from the ends of the fold line 40 and converge to the slit 44, intersecting the slit 44 at spaced points. It can be seen that the resulting retaining flap is made up of a central face or section 52 bounded by the fold lines 40 and 50 and the slit 44, and of two side faces or sections 54 bounded by the slits 44, 46 and 48 and the fold lines 50.

The inner bottom panel flap 24 includes two modified T-shaped openings or slots 56 located so as to be aligned with the retainer flaps 32 when the inner and outer bottom panel flaps are overlapped to form the bottom panel of the carrier. Each cutout or slot 56 comprises a relatively wide elongated slot portion 58 extending from a transverse slot portion 60. The slot portion 58 is spaced from and extends transversely of the nearest panel end edge 62, while the slot portion 60 extends outwardly of the slot portion 58 at the end thereof farthest from the panel end edge 62. The slot portion 60 extends generally parallel to the end edge 62. The slot portion 58 is defined by an edge 64 which is spaced from and parallel to the panel end edge 62 and by edges 66 which converge toward the interior of the carrier. The slot portion 60 is defined by an edge 68 which is also parallel to the panel end edge 62 and by edges 70 which connect the edge 68 to the slots 66 at their closest spacing. The angular portion of the inner bottom panel flap 24 adjacent the intersection of edges 66 and 70 comprises opposing tabs 72.

Still referring to FIGS. 3 and 4, the bottom panel flaps are designed to be mechanically connected in a manner generally known in the prior art. The outer bottom panel flap 26 is connected to an end margin flap 74 along fold line 76. The fold line 76 is interrupted in the central portion by a slit defining a male locking tab 78 and on either side of the tab 78 by the slits 46 which coincide with the fold line 76. The margin flap 74 also contains a centrally located locking opening 80 the interior edge 82 of which extends a substantial distance beyond the side edges of the opening.

The inner bottom panel flap 24 contains a centrally located male locking tab 84 defined by end slit 86, side slits 88, angled slits 90 which form a neck portion, and fold line 92. The locking tab 84 is part of a larger tab or flap 94 which is connected to the inner bottom flap 30 along fold line 96 and which further is defined by slits 98 extending from the ends of the fold line 96 to the slits 90 of the locking tab 84.

Figure 5:
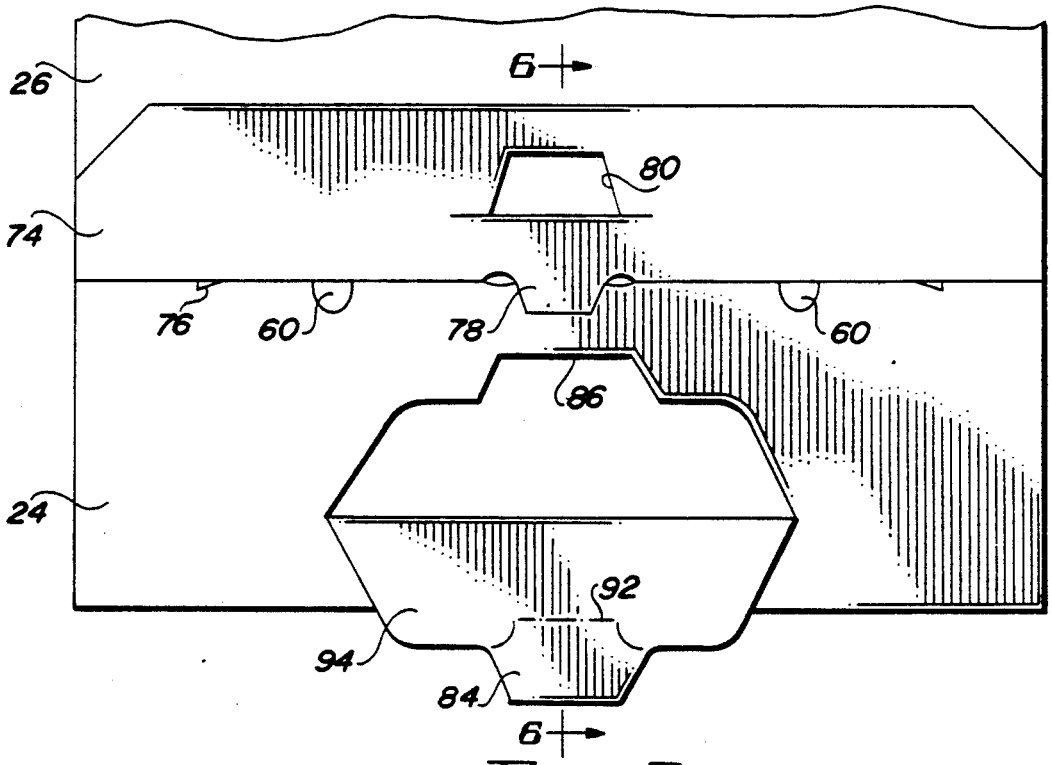
FIG. 5 is an enlarged plan view of the inner and outer bottom panel flaps in overlapped condition, with locking flap portions shown in an intermediate stage of the locking process.

To lock the bottom panel flaps together, they are positioned in overlying relationship, with the end margin flap 74 of the outer bottom panel flap and the tab 94 of the inner bottom panel flap being folded back as illustrated in FIGS. 5 and 6. As shown, a small portion of one end of the slot 60 is visible below the folded-back margin 74. The outer bottom flap 26 is then moved to align the locking tab 78 of the margin 74 with the locking edge 86 of the inner bottom flap 24. By folding the margin flap 74 back to its original position the locking tab 78 engages the locking edge 86 and the underside of the inner bottom panel flap 24 to mechanically hold the bottom panel flaps together as the primary lock of the bottom panel. The tab 94 is then folded back to its original position and the locking tab 84 is folded about its fold line 92 into the locking opening 80 through the slit 82 to effect a secondary lock. This arrangement is illustrated in FIGS. 7 and 8.

Figure 7:
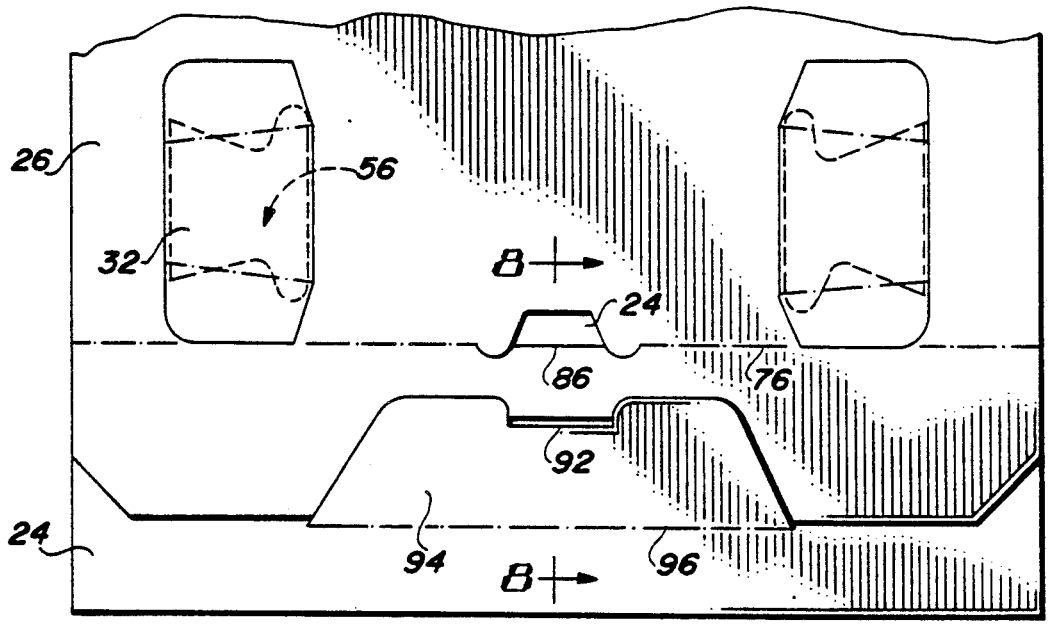
FIG. 7 is a plan view similar to that of FIG. 5, but showing the inner and outer bottom panel flaps in locked condition.

It can be seen in FIG. 7 that when the bottom panel flaps are locked together, the retaining flaps 32 are positioned directly over the openings or slots 56. Note that the openings 56 are shown in dotted lines in FIG. 7 while the retainer flaps 32 are shown in solid lines, depicting the slits, and in dot-dash lines, depicting the fold lines of the retaining flaps. Pressure exerted on the central body sections 52 of the retainer flaps by an externally located movable punch or rod element, not shown but which will be understood by those skilled in the art preferably to be an operating element in an automatic packaging machine, will cause the retainer flaps to be pivoted up about their fold lines 40 and pushed up into the interior of the carrier through the openings 56 in the inner bottom panel flap 24. A typical intermediate position of the retaining flap as it would appear during this movement is illustrated in FIG. 9, which shows the bottom of the retaining flap, and in FIG. 10, which shows the upper portion of the retaining flap as it emerges into the interior of the carrier. It will be seen that movement of the retainer flaps through the slots in this manner causes the side retainer sections 54 to fold about their fold lines 50 as a result of their contact with the edges of the elongated slot portions 58. In particular, it will be seen that the side retaining flap sections 54 contact the tabs 72 formed by the edges of the openings 56 and bend them back slightly as shown in FIGS. 9 and 10. As the side retainer sections 54 are folded in, the bending back of the tabs 72 will have ceased but the tabs will still be urged back to their original position due to the combination of stiffness and flexibility of the paperboard material. The tabs thus exert a biasing force against the side sections.

Continued pivoting movement of the retaining flaps about the fold lines 40 will continue to fold the side sections 54 of the retaining flap until the retaining flap reaches its fully extended position in the interior of the carrier. This position, as illustrated in FIGS. 2 and 11, can be seen to be substantially vertical. The continued urging of the tabs 72 against the side sections 54 helps to maintain the retaining flaps in their fully elevated position. As best shown in FIG. 11, the side sections 54 are located so as to contact the sides of the tubs or other articles T so that the tubs are securely held between the side panels of the carrier and the retaining flap. The articles are thus divided and separated and at the same time the carrier bottom is stabilized.

It was previously stated that the fold lines 40 of the retaining flaps could be other than straight, as for example, curved or angled. If desired, the fold lines could be curved or angled slightly facing the end edges of the bottom panel. This tends to bias the central section 52 of the retaining flap in the direction toward its original position in the plane of the outer bottom panel flap, and in so doing the central section is biased against the intervening articles.

The dimensions of the retaining flap are selected to cause the side flap sections to engage adjacent articles in the carrier. The converging fold lines separating the central section of the retaining flaps from the side sections are angled so that entry of the leading narrow end of the retaining flap into the space between adjacent articles is facilitated.

It can be appreciated that the article retaining means of the invention provides an effective retainer which engages substantial portions of the end tubs or other articles in a carrier which have spaced bottom portions, and does so without adding to the material cost of the carrier blank. In addition, the retaining means provides an additional mechanical lock between the flaps forming the bottom panel, thus further ensuring against the accidental escape of articles from the carrier through failure of the bottom panel.

Although the mechanical locking means for the bottom panel flaps need not be limited to the type shown, it is preferred because of its proven ability to hold the panel flaps in locked condition against severe stresses and because it is especially suitable for use with the retaining means of the invention. For example, even though the retaining flaps are required to be located at a point in the outer bottom panel flap immediately adjacent the locking margin, by making the outer edge of the retaining flap coincide with the fold line of the locking margin 74 of the outer bottom panel flap, both the retaining flap elements and the locking tabs can be properly located with respect to each other.

Although not illustrated, it will be understood that the top panel may be provided with handle openings if desired, to facilitate lifting and carrying.

It should now be apparent that the invention need not be limited to all the specific details described in connection with the preferred embodiment, but that changes to certain features of the preferred embodiment which do not alter the overall basic function and concept of the invention may be made without departing from the spirit and scope of the invention, as defined in the claims.

What is claimed is:

1. A wrap-around article carrier containing a plurality of adjacent rows of articles the bottom portions of which are spaced apart, comprising:

a top panel;

opposite side panels connected to the top panel;

a bottom panel having two end edges and two side edges, the bottom panel comprising an inner bottom panel flap connected at one of the side edges of the bottom panel to one of the side panels and an outer bottom panel flap overlying the inner bottom flap and being connected at the other side edge of the bottom panel to the other side panel, the end edges of the bottom panel connecting the side edges thereof and extending transversely thereof;

the inner bottom panel flap containing an opening located near one of the end edges of the bottom panel, the opening having an inner edge portion and an outer edge portion, the outer edge portion being located closer to the associated end edge of the bottom panel than is the inner edge portion; and the outer bottom panel flap including an integral article retaining flap hingedly connected thereto adjacent the inner edge portion of the opening along a fold line extending substantially parallel to the adjacent end edge of the bottom panel of the carrier, the article retaining flap extending through said opening between end articles in the adjacent rows to maintain the bottom portions of the end articles spaced apart.

2. A wrap-around article carrier containing a plurality of adjacent rows of articles the bottom portions of which are spaced apart, comprising:

a top panel;

opposite side panels connected to the top panel;

a bottom panel having end edges and side edges, the bottom panel comprising an inner bottom panel flap connected at a side edge to one of the side panels and an outer bottom panel flap overlying the inner bottom flap and being connected at a side edge to the other side panel;

the inner bottom panel flap containing an opening located near an end edge of the carrier, the opening having an inner edge portion and an outer edge portion, the outer edge portion being located closer to the associated end edge of the bottom panel than is the inner edge portion; and the outer bottom panel flap including an integral article retaining flap hingedly connected thereto adjacent the inner edge portion of the opening along a fold line extending substantially parallel to the adjacent end edge of the bottom panel of the carrier, the article retaining flap containing spaced fold lines extending transversely of the retaining flap fold line and extending through said opening between end articles in the adjacent rows to maintain the bottom portions of the end articles spaced apart.

3. The wrap-around carrier of claim 1, including interconnected mechanical lock means on the inner and outer bottom flaps for assisting the retaining flap in locking the inner and outer bottom panel flaps together.

4. The wrap-around carrier of claim 1, wherein the carrier includes a retaining flap adjacent each end of the carrier.

5. The wrap-around carrier of claim 2, wherein the transversely extending fold lines in the retainer flap divide the retainer flap into a central section and two side sections extending at an angle to the central section, the opening in the inner bottom panel flap having side edge portions in contact with the side sections of the retainer flap, said side edge portions being spaced apart a distance such that they exert a biasing force on said side sections.

6. The wrap-around carrier of claim 2, wherein the transverse fold lines converge in a direction away from the retaining flap fold line.

7. A substantially rectangular blank for forming a wrap-around article carrier adapted to carry a plurality of adjacent rows of articles the bottom portions of which are spaced apart, comprising:

a top panel section;

side panel sections connected to opposite sides of the top panel section;

an inner bottom panel flap connected to one of the side panel sections along a first fold line and an outer bottom panel flap connected to the other side panel section along a second fold line, the outer bottom panel flap being adapted to overlie the inner bottom panel flap in the bottom panel of a carrier formed from the blank, the inner and outer bottom panel flaps having end edges extending transversely of the first and second fold lines;

the inner bottom panel flap containing an opening located near an end edge of the inner bottom panel flap, the opening including inner and outer edge portions, the outer edge portion being located closer to said end edge than the inner edge portion; and the outer bottom panel flap including an integral article retaining flap hingedly connected thereto adjacent the inner edge portion of the opening along a fold line extending substantially parallel to the adjacent end edge of the outer bottom panel flap, the article retaining flap adapted to be pivoted through said opening between end articles in adjacent rows of articles in a carrier formed from the blank to maintain the bottom portions of the end articles spaced apart.

8. A substantially rectangular blank for forming a wrap-around article carrier adapted to carry a plurality of adjacent rows of articles the bottom portions of which are spaced apart, comprising:

a top panel section;

side panel sections connected to opposite sides of the top panel section;

an inner bottom panel flap connected to one of the side panel sections and an outer bottom panel flap connected to the other side panel section, the outer bottom panel flap being adapted to overlie the inner bottom panel flap in the bottom panel of a carrier formed from the blank;

the inner bottom panel flap containing an opening located near an end edge of the inner bottom panel flap, the opening including inner and outer edge portions, the outer edge portion being located closer to said end edge than the inner edge portion; and the outer bottom panel flap including an integral article retaining flap hingedly connected thereto adjacent the inner edge portion of the opening along a fold line extending substantially parallel to the adjacent end edge of the outer bottom panel flap, the retaining flap containing spaced fold lines extending transversely of the retaining flap fold line, the article retaining flap adapted to be pivoted through said opening between end articles in adjacent rows of articles in a carrier formed from the blank to maintain the bottom portions of the end articles spaced apart.

9. The wrap-around carrier blank of claim 7, including mechanical locking means on the inner and outer bottom panel flaps, the mechanical locking means being adapted to be interlocked in a carrier formed from the blank to assist the retaining flap in locking the inner and outer bottom panel flaps together.

10. The wrap-around carrier blank of claim 7, wherein the carrier blank includes a retaining flap adjacent each end of the outer bottom flap.

11. The wrap-around carrier blank of claim 8, wherein the transversely extending fold lines in the retaining flap divide the retaining flap into a central section and two side sections extending at an angle to the central section, the opening in the inner bottom panel flap having side edge portions adapted to be in contact with the side sections of the retaining flap in a carrier formed from the blank, said side edge portions being spaced apart a distance such that they exert a biasing force on said side sections.

12. The wrap-around carrier blank of claim 8, wherein the transverse fold lines converge in a direction away from the retaining flap fold line.

* * * * *